US008496717B2

(12) United States Patent
Neels et al.

(10) Patent No.: US 8,496,717 B2
(45) Date of Patent: Jul. 30, 2013

(54) ACTIVELY COOLED FUEL PROCESSOR

(75) Inventors: Jacobus Neels, Rosedale (CA); Xuantian Li, Vancouver (CA)

(73) Assignee: Westport Power Inc., Vancouver, BC (CA)

( * ) Notice: Subject to any disclaimer, the term of this patent is extended or adjusted under 35 U.S.C. 154(b) by 643 days.

(21) Appl. No.: 12/406,648

(22) Filed: Mar. 18, 2009

(65) Prior Publication Data

US 2009/0235585 A1 Sep. 24, 2009

Related U.S. Application Data

(60) Provisional application No. 61/037,599, filed on Mar. 18, 2008.

(51) Int. Cl.

| | |
|---|---|
| ***C01B 3/36*** | (2006.01) |
| ***B01J 7/00*** | (2006.01) |
| ***B01J 19/00*** | (2006.01) |
| ***B01J 8/00*** | (2006.01) |

(52) U.S. Cl.
USPC ..... 48/197 R; 48/61; 422/198; 422/625

(58) Field of Classification Search
USPC ..... 48/197 R; 423/644, 648.1; 422/198
See application file for complete search history.

(56) References Cited

U.S. PATENT DOCUMENTS

| | | | | |
|---|---|---|---|---|
| 4,988,486 | A | 1/1991 | Harris et al. | |
| 6,303,009 | B1 | 10/2001 | Bossard | |
| 6,613,466 | B1 | 9/2003 | Schuessler | |
| 6,641,625 | B1 | 11/2003 | Clawson et al. | |
| 6,732,942 | B1 | 5/2004 | Sangwan et al. | |
| 7,132,178 | B2 | 11/2006 | Ukai et al. | |
| 7,648,686 | B2 | 1/2010 | Reinke et al. | |
| 2004/0101722 | A1* | 5/2004 | Faye et al. | 429/20 |
| 2004/0258971 | A1* | 12/2004 | Gyoten et al. | 429/26 |
| 2005/0081444 | A1* | 4/2005 | Anumakonda et al. | 48/214 A |
| 2005/0081514 | A1* | 4/2005 | Nakada | 60/286 |
| 2005/0220684 | A1 | 10/2005 | Reinke et al. | |
| 2006/0179819 | A1* | 8/2006 | Sullivan | 60/275 |
| 2007/0227070 | A1 | 10/2007 | Fischer et al. | |
| 2008/0145297 | A1 | 6/2008 | Johannes et al. | |
| 2008/0274021 | A1 | 11/2008 | Neels et al. | |

* cited by examiner

*Primary Examiner* — Matthew Merkling
(74) *Attorney, Agent, or Firm* — Corridor Law Group, PC

(57) ABSTRACT

A fuel processor for producing a hydrogen-containing product stream from a fuel stream and an oxidant stream is actively-cooled by a gaseous or liquid coolant which is directed to flow in contact with at least a portion of the outer shell of the fuel processor. Active cooling can improve the operating characteristics of the fuel processor as well as allowing for the use of compact fuel processor designs that would otherwise tend to have insufficient heat loss capability.

11 Claims, 1 Drawing Sheet

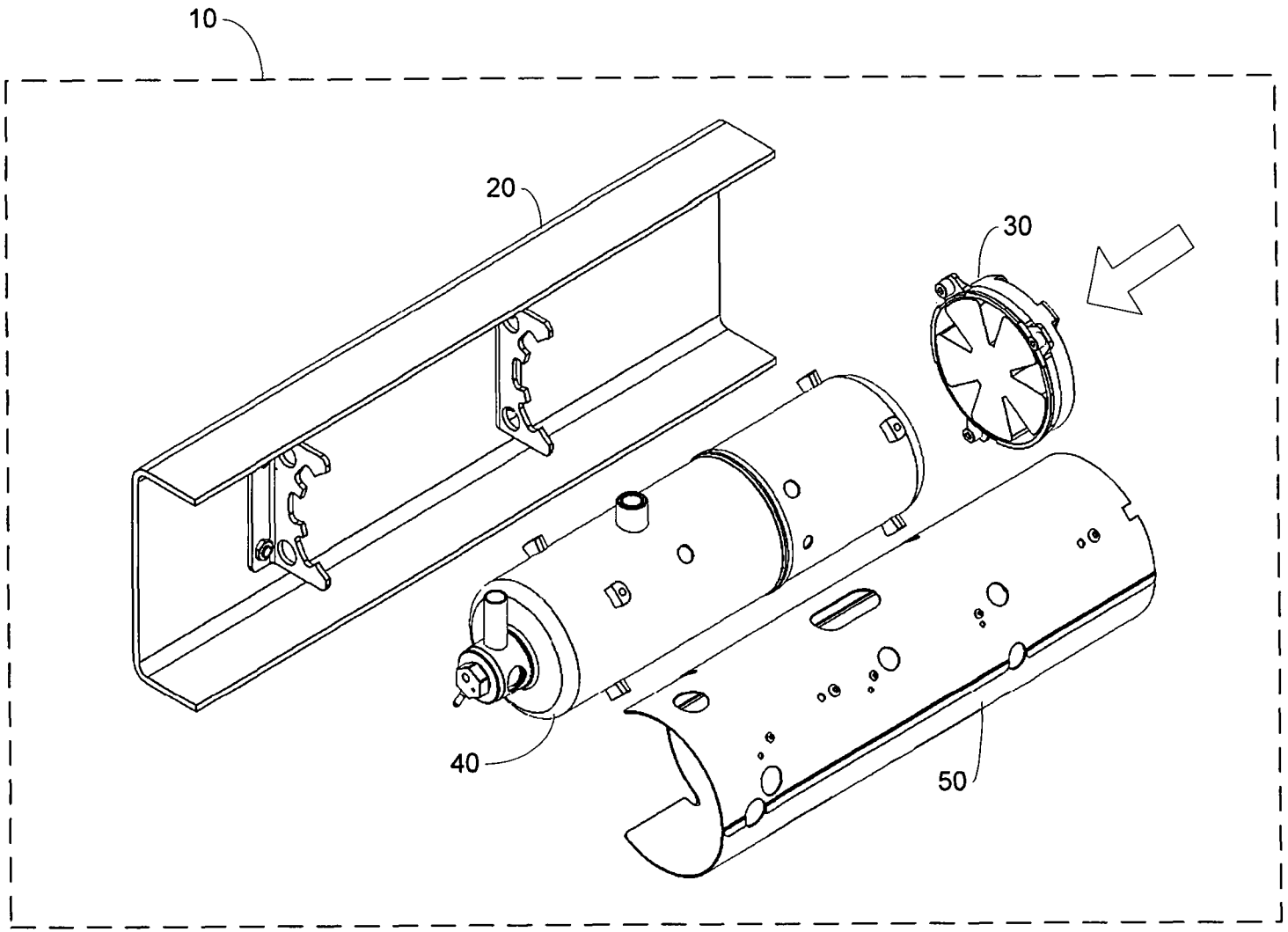
10
20
30
40
50

ACTIVELY COOLED FUEL PROCESSOR

CROSS-REFERENCE TO RELATED APPLICATION

This application is related to and claims priority benefits from U.S. Provisional Patent Application Ser. No. 61/037,599, entitled "Actively Cooled Fuel Processor", filed on Mar. 18, 2008, which is hereby incorporated by reference in its entirety.

FIELD OF THE INVENTION

The present invention relates to a fuel processor for producing a hydrogen-containing gas stream, such as a syngas stream. The present apparatus and methods are particularly suitable for fuel processors that are used in engine system applications, where a hydrogen-containing gas is required and space is limited.

BACKGROUND OF THE INVENTION

For engine systems in vehicular or other mobile applications where a supply of hydrogen is required, due to challenges related to on-board storage of a secondary fuel and the current absence of a hydrogen refueling infrastructure, hydrogen is preferably generated on-board using a fuel processor. The hydrogen-containing gas from the fuel processor can be used to regenerate, desulfate and/or heat engine exhaust after-treatment devices, can be used as a supplemental fuel for the engine, and/or can be used as a fuel for a secondary power source, for example, a fuel cell.

One type of fuel processor is a syngas generator (SGG) that can convert a fuel into a gas stream containing hydrogen ($H_2$) and carbon monoxide (CO), known as syngas. Air and/or a portion of the engine exhaust stream can be used as an oxidant for the fuel conversion process. The exhaust stream typically contains oxygen ($O_2$), water ($H_2O$), carbon dioxide ($CO_2$), nitrogen ($N_2$) and sensible heat, which can be useful for the production of syngas. Steam and/or water can optionally be added. The fuel supplied to the SGG can conveniently be chosen to be the same fuel that is used in the engine. Alternatively a different fuel can be used, although this would generally require a separate secondary fuel source and supply system specifically for the SGG. The $H_2$ and CO can be beneficial in processes used to regenerate exhaust after-treatment devices. For other applications, for example, use as a fuel in a fuel cell, the syngas stream may require additional processing prior to use.

In vehicular or other mobile applications, an on-board SGG should generally be low cost, compact, light-weight, of low power consumption and efficiently packaged with other components of the engine system. Some particular challenges associated with the design of fuel processors used in engine systems to convert a fuel and engine exhaust gas stream into a hydrogen-containing stream include the following:

(a) Engine exhaust stream output parameters, such as mass flow, pressure, temperature, composition and emission levels, vary significantly over the operating range of the engine.

(b) The output required from the fuel processor is typically variable. The hydrogen-containing gas stream is preferably generated as-needed in accordance with the variable demand from the hydrogen-consuming devices. This reduces the requirement for additional storage and control devices.

(c) High system reliability and durability are typically required.

(d) The fuel processor should be capable of operating over a wide ambient temperature range, different elevations and under a range of other external and environmental conditions.

The thermochemical conversion of a hydrocarbon fuel to syngas is performed in a SGG at high operating temperatures with or without the presence of a suitable catalyst. Parameters including, equivalence ratio, oxidant-to-carbon ratio, steam-to-carbon ratio, and operating (reaction) temperature are typically adjusted in an attempt to increase the efficiency of the fuel conversion process while reducing the undesirable formation of carbon (coke or soot), which can cause undesirable effects within the SGG and/or on downstream components.

Typically, a high SGG operating temperature is desired in order to increase the fuel conversion efficiency of the process and to reduce the size of the SGG. However, excessive operating temperatures can cause undesirable effects including catalyst sintering, formation of loose, amorphous soot and the requirement for the use of thermally robust specialty materials. Insufficient operating temperatures can cause undesirable effects including reduced chemical kinetics, reduced stability of a reaction flame, low fuel conversion, high concentrations of unconverted hydrocarbons in the product syngas, and formation of dense, more graphitic carbon or coke. In conventional SGGs, thermal insulation is often employed to reduce the amount of heat lost from the fuel processor.

An increase in fuel conversion of the SGG can enable a desirable reduction in volume of the SGG for a given syngas output. This reduction in volume can however result in a decrease in the surface area of the SGG, reducing the heat transfer capacity from the SGG to the ambient environment. During some operating conditions of a SGG, a passive method of dissipating waste heat can be insufficient to prevent excessive operating temperatures.

The present fuel processor with improved design, components and operating methods is effective in addressing at least some of the issues discussed above, both in engine system applications and in other fuel processor applications.

SUMMARY OF THE INVENTION

A method of operating a fuel processor to produce a hydrogen-containing product stream comprises:

(a) introducing a fuel stream and an oxidant stream into the fuel processor, and mixing them to form a combined reactant stream;

(b) combusting and converting the combined reactant stream into the hydrogen-containing product stream, thereby generating heat; and (c) directing a cooling medium to flow in contact with at least a portion of an outer shell of the fuel processor to increase the rate of heat loss from the fuel processor whereby the fuel processor operates within a desired temperature range.

For example, in step (c) an electrically powered device, such as a fan or a pump, can be used to direct the cooling medium to flow in contact with at least a portion of the outer shell of the fuel processor.

In preferred embodiments of the method, the cooling medium is directed to flow substantially continuously while the fuel processor is producing the hydrogen-containing product stream. If an electrically powered device is used to direct the cooling medium to flow, in this case the device can be operated substantially continuously while the fuel processor is producing the hydrogen-containing product stream.

The flow rate of the cooling medium can be substantially constant or, in more complex embodiments, can be variable.

In other embodiments of the method, flow of the cooling medium in step (c) can be activated when a monitored parameter exceeds a pre-determined threshold value. Similarly, flow of the cooling medium in step (c) can be deactivated when a monitored parameter falls below a pre-determined threshold value. Alternatively or in addition, the flow rate of the cooling medium can be adjusted based on the rate of change to a monitored parameter. The monitored parameter can be, for example, a temperature of the fuel processor (for example, an internal temperature or a shell temperature), or a temperature of the hydrogen-containing product stream.

In further embodiments of the above described method, in step (c) the flow of the cooling medium can be passively controlled, rather than being actively controlled in response to some monitored parameter.

The above-described methods can further comprise introducing a water-containing stream into the fuel processor. Also, the fuel stream can comprise diesel fuel and/or the oxidant can comprise exhaust gas from a combustion engine and/or air.

The rate of heat loss achieved through step (c) can reduce the formation of carbon within the fuel processor.

Thus, a method for reducing the formation of carbon during operation of a fuel processor to produce a hydrogen-containing product stream, comprises directing a cooling medium to flow in contact with at least a portion of the outer shell of the fuel processor to increase the rate of heat loss from the fuel processor, thereby maintaining the temperature of the fuel processor within a desired range.

Again, in preferred embodiments the cooling medium is directed to flow in contact with at least a portion of the outer shell of the fuel processor substantially continuously while the fuel processor is producing the hydrogen-containing product stream, and optionally at a substantially constant flow rate.

The flow of the cooling medium can be passively controlled, for example, based on pre-programmed logic.

The method for reducing the formation of carbon can further comprise controlling the flow rate of the cooling medium. The flow rate can be actively controlled based on at least one monitored parameter and based on pre-programmed logic. The monitored parameter can be, for example, a temperature of the fuel processor (for example, an internal temperature or a shell temperature), or a temperature of the hydrogen-containing product stream.

A fuel processor for producing a hydrogen-containing product stream from a fuel stream and an oxidant stream, that has improved heat transfer capability comprises:

(a) an outer shell;

(b) a coolant circulation device for directing a cooling medium to flow in contact with at least a portion of the outer shell; and (c) a controller to activate and control the coolant circulation device.

The device can be an electrically-powered device, such as a fan or pump. The cooling medium can be a gas, such as air or engine exhaust, or a liquid.

Preferably the fuel processor further comprises a shroud and wherein the coolant circulation device causes the cooling medium to flow between the shroud and the outer shell.

The controller can be preferably configured to activate coolant circulation device to operate substantially continuously while the fuel processor is producing the hydrogen-containing gas stream. Alternatively, the controller can be configured to transmit a signal to the coolant circulation device based on a sensed signal and pre-programmed control logic.

The above described techniques are particularly suitable for fuel processors in which the surface area-to-volume ratio of the outer shell is in the range of about 0.04 $m^2/l$ to about 0.06 $m^2/l$.

In preferred embodiments of the above described method and apparatus, the fuel processor is a non-catalytic syngas generator, and the desired temperature range is from about 500° C. to about 1400° C., or more preferably from about 900° C. to about 1400° C., and even more preferably from about 1000° C. to about 1200° C.

BRIEF DESCRIPTION OF THE DRAWING(S)

FIG. 1 is an exploded view of an actively cooled syngas generator assembly, illustrating the major mechanical sub-assemblies.

DETAILED DESCRIPTION OF PREFERRED EMBODIMENT(S)

A compact fuel processor, where the overall volume occupied by the fuel processor for a given syngas output capability is reduced, can be desirable especially in mobile applications. In some cases more compact fuel processor designs can result an undesirable lower heat transfer capacity to the ambient environment (that is, the surrounding atmosphere). For example, this can be because the external surface area of the fuel processor has been reduced for a given internal reaction chamber volume as the overall volume is reduced, and/or because it is desirable to operate the fuel processor with higher reactant flow and conversion rates for a given reaction chamber volume (which will tend to generate more heat), and/or because in some cases a more spherical reactor shape or an aspect ratio (defined as the ratio of the largest dimension to the smallest dimension) closer to unity is used, which results in a lower external surface area-to-volume ratio. To offset the lower heat transfer capacity, an active method of cooling can be employed with a fuel processor to increase its heat transfer capacity, allowing the fuel processor to operate within a desired operating temperature range and with a desired shell temperature range. For example, it has been found that active cooling can be used to maintain the operating temperature of a syngas generator with a surface area-to-volume ratio of about 0.048 $m^2/l$ within a desired temperature range. Furthermore, active cooling can optionally be employed during a shut-down process of the fuel processor to reduce its temperature, and during some operating conditions of the fuel processor, the active cooling can reduce a tendency for carbon formation during the fuel conversion process. For example, active cooling can allow the fuel processor to be operated at an equivalence ratio that reduces carbon accumulation without the fuel processor overheating. Additional factors that can influence the desired operating temperature range and the degree of cooling required include, for example, the equivalence ratio of the oxidant and fuel reactants, thermal insulation characteristics of the fuel processor, the heat transfer medium and flow of the active cooling method, and the ambient temperature in which the fuel processor operates.

FIG. 1 illustrates an exploded view of an actively cooled syngas generator (SGG) assembly 10, illustrating the major mechanical assemblies, frame 20, fan 30, SGG 40 and shroud 50.

Frame 20 can be used to attach SGG assembly 10, to a vehicle, engine sub-assembly or other assembly (not shown in FIG. 1). Frame 20 can function to assist in protecting personnel and other vehicular or system components from the high temperatures of the SGG (thermal protection); protecting the SGG from physical damage including vibration, and impact by foreign objects (mechanical protection); guiding the flow of cooling air; acting as a heat sink to cool the SGG; and serving as an attachment platform for other optional components, for example, pumps, valves, heat exchangers, controllers, electronics and other fuel processing equipment (not shown in FIG. 1).

SGG 40, attached to frame 20, is fluidly connected to a fuel supply, an oxidant supply and an optional downstream fuel processing device or a hydrogen-consuming device (not shown in FIG. 1). During normal operation, the internal temperature within SGG 40 can reach as high as about 1400° C., with an external shell temperature typically reaching as high as about 450° C. SGG 40 can comprise optional cooling fins (not shown) to increase its surface area and heat transfer capacity in order to reduce the temperature and/or increase heat flux.

In one embodiment, SGG 40 can be actively cooled by flowing or circulating a cooling medium, for example, air or a liquid coolant, over at least a portion of the shell of SGG 40, during at least a portion of the operating time of SGG 40. The activation, rate of flow, and/or duration of flow of the cooling medium can be varied to provide a desired rate of cooling or change in temperature, and/or operating temperature within SGG 40 and/or external shell temperature of SGG 40. A control device, such as a programmable controller, can be employed with optional sensors which monitor SGG 40, and/or a product stream of SGG 40, to actively control the flow of the cooling medium with a pre-programmed control logic, for example, algorithm, look-up table or a combination of the two. In preferred embodiments, the flow of the cooling medium can be controlled passively, with or without use of a controller, based on and pre-programmed algorithms rather than based on real-time feedback from sensors. For example, a cooling fan can be set at a substantially constant speed and turned on or off along with the SGG and/or other higher level system signals; or a cooling fan can be activated (on or off) and/or its speed adjusted on a preset time basis and/or preset duty cycle basis of the SGG and/or SGG system signals. The control logic can be programmed into a dedicated controller for the SGG or incorporated into another controller within the SGG or higher level (vehicular/power) system.

Control of the heat loss characteristic and lowering of the temperature of SGG 40 can be especially desirable during some operating conditions, to reduce carbon formation during the fuel conversion process resulting in less frequent need for regeneration of the internal carbon filter and/or a reduction in the tendency for catalyst sintering, and/or reduction in time to reach a desired temperature during the shut-down process of the fuel processor. The use of active cooling can offer additional advantages including, enabling the reduction in volume of the SGG by increasing heat transfer capacity of the SGG, improving product and/or process safety by dissipating thermal energy and/or leakage than may occur from the SGG to the ambient environment and enabling the use of lower cost, less thermally durable materials and/or components by limiting the maximum operating temperature. The cooling medium can be optionally employed to cool the hydrogen-containing product stream from the SGG, one or more reactant stream supplied to the fuel processor and/or other fuel processor devices including for example, valves, catalyst beds and water-gas shift conversion devices.

In the illustrated embodiment, fan 30 is an electrically powered axial fan, with a close coupled electric motor attached to the outer shell of SGG 40. Fan 30 can be of various designs including for example, centrifugal, variable speed, variable pitch, and other suitable types. Other devices or means for increasing the heat transfer capacity from SGG 40 can be used instead of a fan. In the illustrated embodiment, fan 30 draws in ambient air, forces the air through a chamber created by shroud 50, frame 20, SGG 40, and back into the surrounding atmosphere through openings. The air, acting as a cooling medium, can reduce the temperature of SGG 40. The control device for fan 30 can be an individual controller specific to the operation of fan 30 or can be integrated into other system or sub-system controllers, for example, engine control module, exhaust after-treatment controller, auxiliary power controller, SGG or fuel processor controller (not shown in FIG. 1). A self diagnostic system can be integrated into the control protocol, for example, a component malfunction signal and/or a requirement for service signal can be sent when particular conditions are detected. Power to fan 30 can be supplied via an electrical sub-system of the vehicle, engine or power system. Alternatively, a thermoelectric generating device can be attached to SGG 40, generating and supplying power to fan 30 and/or other devices. The cooling medium can instead be drawn through the chamber created by shroud 50, frame 20, SGG 40 by a device fluidly connected downstream of the chamber, for example an air compressor intake which is fluidly connected to the chamber or a fan.

Shroud 50 is attached to SGG 40 and/or frame 20, and forms a chamber around SGG 40 which is open to the atmosphere at one end. Shroud 50 directs the flow of air from fan 30, via the chamber and back into the surrounding atmosphere through the opening. Optional additional openings can surround optional sensors, controllers, ignition devices (glow plugs) and/or other devices (not shown in FIG. 1) to cool these devices, allowing for the use of lower cost, less thermally durable devices. Shroud 50 also functions to protect personnel from the hot surfaces of SGG 40, and to protect SGG 40 from foreign objects including dirt, water and other debris. Shroud 50 can comprise one or more shrouds each constructed of stainless steel or other suitable materials and of one or more layers. Alternatively, a layer of suitable thermal insulating material can be employed along with shroud 50 and/or frame 20 to offer additional thermal protection from the hot surfaces of SGG 40.

In some embodiments applications, a liquid coolant can be employed. A cooling chamber or jacket can be disposed around at least a portion of SGG 40, allowing for the flow or circulation, containment and optionally pressurization of a liquid coolant. The cooling chamber can be constructed within the shell of SGG 40 or as a separate component using suitable materials. The liquid coolant can be supplied via a coolant sub-system of the vehicle, engine, or power system, or an independent coolant supply sub-system comprising appropriate devices for example, a heat exchanger, a coolant recirculation device, valves, lines and sensors. Suitable liquid coolants can be used, taking into consideration, for example, materials compatibility issues, and the boiling point and freezing temperature of the coolant in relation to the anticipated temperature range to which it will be exposed. In some embodiments, for example, engine coolant or engine oil can be circulated through an SGG cooling chamber or jacket.

The above-described active cooling apparatus and methods can be employed with fuel processors of the type described in U.S. patent application Ser. No. 12/112,784 filed Apr. 30, 2008 (published Nov. 6, 2008 as U.S. Patent Application Publication No. 2008/0274021, entitled "Compact Fuel Processor", and U.S. patent application Ser. No. 11/935,282 filed Nov. 5, 2007 (published Jun. 19, 2008 as U.S. Patent Application Publication No. 2008/0145297, entitled "Fuel Processor, Components Thereof and Operating Methods Therefor", each of which is hereby incorporated by reference herein in its entirety.

In preferred embodiments of the apparatus and methods described above, the fuel processor is a syngas generator (SGG) that is a non-catalytic partial oxidation reformer, which during normal operation is operated to produce a syngas stream. However, the apparatus and methods as described herein can be incorporated into various types of fuel processors including other types of SGG, and other reformers or reactors used to produce hydrogen-containing gas streams. These can be of various types, for example, catalytic partial oxidizers, non-catalytic partial oxidizers, and/or autothermal reformers, with or without suitable reforming and/or water-gas shift catalysts.

The fuel supplied to the fuel processor can be a liquid fuel (herein meaning a fuel that is a liquid when under IUPAC defined conditions of standard temperature and pressure) or a gaseous fuel. Suitable liquid fuels include, for example, diesel, gasoline, kerosene, liquefied natural gas (LNG), fuel oil, methanol, ethanol or other alcohol fuels, liquefied petroleum gas (LPG), or other liquid fuels from which hydrogen can be derived. Alternative gaseous fuels include natural gas and propane.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A method of operating a fuel processor to produce a hydrogen-containing product stream, said method comprising:

(a) introducing a fuel stream and an oxidant stream into said fuel processor, and mixing them to form a combined reactant stream;

(b) combusting and converting said combined reactant stream into said hydrogen-containing product stream, thereby generating heat; and (c) directing a cooling medium to flow in contact with at least a portion of an outer shell of said fuel processor to increase the rate of heat loss from said fuel processor whereby said fuel processor operates within a desired temperature range, wherein said cooling medium flow is activated when a monitored parameter exceeds a pre-determined threshold value, and wherein said cooling medium comprises engine exhaust from an internal combustion engine.

2. The method of claim 1 wherein said cooling medium is directed to flow in contact with at least a portion of the outer shell of said fuel processor substantially continuously while said fuel processor is producing said hydrogen-containing product stream.

3. The method of claim 1 wherein flow of said cooling medium in step (c) is deactivated when said monitored parameter falls below a pre-determined threshold value.

4. The method of claim 1 wherein the flow rate of said cooling medium is adjusted based on the rate of change of said monitored parameter.

5. The method of claim 1 wherein said monitored parameter is a temperature of said fuel processor.

6. The method of claim 1 wherein said monitored parameter is a temperature of said hydrogen-containing product stream.

7. The method of claim 1 wherein in step (c) an electrically powered device is used to direct said a cooling medium to flow in contact with at least a portion of the outer shell of said fuel processor.

8. The method of claim 1 wherein said desired temperature range is from about 1000° C. to about 1200° C.

9. A method of operating a fuel processor to produce a hydrogen-containing product stream, said method comprising:

(a) introducing a fuel stream and an oxidant stream into said fuel processor, and mixing them to form a combined reactant stream;

(b) combusting and converting said combined reactant stream into said hydrogen-containing product stream, thereby generating heat; and (c) directing a cooling medium to flow in contact with at least a portion of an outer shell of said fuel processor to increase the rate of heat loss from said fuel processor whereby said fuel processor operates within a desired temperature range, wherein said cooling medium flow is controlled based upon a pre-programmed algorithm and wherein said cooling medium comprises engine exhaust from an internal combustion engine.

10. The method of claim 9 wherein in step (c) an electrically powered device is used to direct said a cooling medium to flow in contact with at least a portion of the outer shell of said fuel processor.

11. The method of claim 9 wherein said desired temperature range is from about 1000° C. to about 1200° C.

* * * * *